US006105669A

United States Patent [19]

Davis

[11] Patent Number: 6,105,669

[45] Date of Patent: Aug. 22, 2000

[54] WELL CASING SEALING DEVICE

[76] Inventor: Emery W. Davis, 2241 Grubbs Mill Rd., Berwyn, Pa. 19312-1935

[21] Appl. No.: 09/139,216

[22] Filed: Aug. 24, 1998

Related U.S. Application Data

[60] Provisional application No. 60/056,941, Aug. 25, 1997.

[51] Int. Cl.[7] ..... E21B 33/03

[52] U.S. Cl. ..... 166/75.13

[58] Field of Search ..... 166/97.1, 75.13, 166/93.1, 94.1, 92.1

[56] References Cited

U.S. PATENT DOCUMENTS

| | | | |
|---|---|---|---|
| 3,035,732 | 5/1962 | Baker | 220/3.8 |
| 3,504,742 | 4/1970 | Crawford . | |
| 3,924,686 | 12/1975 | Arnold . | |
| 4,023,699 | 5/1977 | Lien | 220/3.8 |
| 4,411,312 | 10/1983 | English | 166/75.13 |
| 4,457,448 | 7/1984 | Beagell | 220/327 |
| 4,483,395 | 11/1984 | Kramer et al. . | |
| 4,564,041 | 1/1986 | Kramer . | |
| 4,702,274 | 10/1987 | Kramer . | |
| 4,842,060 | 6/1989 | Paulus . | |
| 4,848,458 | 7/1989 | Holdsworth et al. | 166/92.1 |
| 4,865,138 | 9/1989 | Swietlik . | |
| 4,866,903 | 9/1989 | Ferstay . | |
| 4,867,871 | 9/1989 | Bowne . | |
| 4,886,426 | 12/1989 | Surinak . | |
| 4,928,731 | 5/1990 | Koller . | |
| 4,981,170 | 1/1991 | Dierbeck . | |
| 5,211,229 | 5/1993 | Pecue, II . | |
| 5,372,192 | 12/1994 | Bitting . | |
| 5,377,752 | 1/1995 | Farrara . | |
| 5,390,966 | 2/1995 | Cox et al. . | |
| 5,507,628 | 4/1996 | Masse et al. . | |
| 5,529,462 | 6/1996 | Hawes . | |

*Primary Examiner*—George Suchfield
*Attorney, Agent, or Firm*—Reed Smith Shaw & McClay LLP

[57] ABSTRACT

A device for closing an end of a well casing includes a gasket, a base and a cap. The gasket has an inner diameter that fits around the well casing. The base has an upwardly facing groove for receiving a lower portion of the gasket, a circular opening slightly larger than the exterior diameter of the well casing thereby permitting the base to be positioned about the well casing, and a plurality of lugs positioned about the periphery of the base. The base also includes an annular flange that projects downward from the lower surface of the base, the annular flange has an inwardly facing surface extending axially downward from the groove in the base. The groove in the base has an inwardly facing wall parallel with the flange inner surface and an upwardly facing shoulder perpendicular to the flange inwardly facing wall that connects the flange inwardly facing wall with the groove annular surface. The base has an upwardly facing surface adjoining the groove annular surface. The cap has a downward facing groove for receiving an upper portion of the gasket. The cap includes a plurality of lugs positioned about the outer periphery of the cap, an inwardly facing annular surface parallel with the inwardly facing surface of the flange, and an axially downward facing shoulder surface perpendicular to the inwardly facing annular surface. The lugs of the base and cap are adapted for axial alignment with axial apertures formed in the lugs. Fastener means within the apertures urge the cap and the base towards one another thereby compressing the gasket between the shoulder surfaces and providing a seal about the well casing.

13 Claims, 6 Drawing Sheets

WELL CASING SEALING DEVICE

CROSS REFERENCE TO RELATED APPLICATION

This patent application is based on and claims the benefit of the filing date of U.S. provisional patent application No. 60/056,941 filed Aug. 25, 1997 by Emery W. Davis and entitled SEAL DEVICE FOR A WELL CASING.

FIELD OF THE INVENTION

This invention improves water system assembly and maintenance by providing a well casing and integral electrical conduit sealing device facilitating venting of outside air into a water system while providing a watertight, impact-resistant well casing and electrical conduit sealing device so outside contaminants and sediment do not interfere with system operation.

BACKGROUND OF THE INVENTION

Locally pumped water systems are utilized where traditional municipal or other commercial water service is unavailable, cost prohibitive or of inadequate quality and/or pressure. Such locally pumped water systems are generally subterranean in nature, relying on ground water or conveniently placed storage reservoirs for water supplied to pumping apparatus.

Well casings in locally pumped water systems generally extend from a reservoir or ground water receptacle and typically include a well pump. Well casings typically have an access section which narrows in dimension and terminates in a well casing sealing device. The access section is utilized to service or remove the pump from the well casing for routine maintenance and repair and provides a port for testing ground water quality.

The well casing sealing device generally has two parts. A top section is referred to as the cap and the bottom section is referred to as the base. The well casing sealing device forms a seal about the mouth of the well casing access section via a nut and bolt assembly which couples the seal device cap and base sections together.

The well casing access section, in subterranean and above ground applications, extends to the well casing seal device and has a longitudinal run housing the electrical conduit, to allow simultaneous access to the pump and to electrical power. The electrical conduit is rigidly secured to the well casing seal device.

Known well casing sealing devices utilize a variety of gasket configurations and venting arrangements for air flow between the well casing interior and the external environment. Gaskets provide a watertight seal, preventing contaminants and outside surface water from entering the well casing and contaminating potable water therein.

Known well casing seal devices are typically cast iron, which is costly to manufacture and, when cast, often results in uneven thickness throughout the well seal device. Moreover, such cast iron well casing seal devices may be easily contaminated by salt and other surface de-icers used in adverse weather conditions and once corroded by such chemicals are often difficult to remove after installation. Additionally, such cast iron well casing seal devices can become brittle in cold temperatures, leading to cracking or chipping upon disengagement of the well casing seal from the well casing.

Known, cast iron metallic well casing seal devices may be bolted to the well casing through randomly located positions which are difficult to access. The bolts often rust, becoming difficult to remove once installed. Force necessary to remove such rusted bolts stresses the well casing access section, often compromising or even rupturing the seal formed at the mouth of the well by the well casing sealing device. Uneven placement of the bolts causes some areas of the seal device to be stressed more than other areas when the bolts are removed. This uneven stressing is often aggravated due to location and orientation of the seal device providing limited access to the bolts. Even under ideal weather conditions the seal is often imperfect due to the uneven thickness of the various well casing seal device surfaces when the well casing sealing device is cast.

Metallic, cast iron well casing sealing devices pose a shock hazard to livestock or individuals contacting the well casing sealing device during an electrical conduit fault.

SUMMARY OF THE INVENTION

This invention satisfies the current demand in the art for an improved seal device for a well casing. A well casing seal device is provided in which a single elastomeric sealing gasket extends about the union of a base section and mated cap section, the base having a well casing opening and an electrical conduit supply port. The mated cap section and base are economically manufactured of ABS (acrylonitrile butadiene styrene) having a uniform material thickness throughout, providing greater resistance to impact loading than known heretofore.

The ABS seal device base section comprises a plurality of upwardly facing nut recesses such that the seal device can be readily disengaged without requiring the manipulation of inconveniently located base section bolts. Moreover the base section comprises downwardly facing ventilation ports such that improved ventilation is facilitated.

According to one aspect of this invention a well casing seal is provide wherein the uniform thickness of the seal device wall provides an equiangular sealing force about the mouth of the well casing.

Another aspect of this invention provides a well casing seal device having ventilation apertures within the ABS base section for improved well ventilation.

A further aspect of this invention provides a base section bolt assembly wherein the seal device is easily disengaged from the mouth of the well casing with a minimum of effort and tools while providing an equiangular sealing force.

Yet another aspect of this invention provides a well casing seal device wherein the manufacture of the device provides a device of uniform tolerances, quality and dependability, having improved impact and corrosion resistance.

Still another aspect of the present invention provides a well casing seal device wherein the unitary elastomeric gasket provides a more consistent seal between the device cap and base sections.

Still other benefits and advantages of this invention will become apparent to those skilled in the art upon a reading and understanding of the following detailed specification and related drawings.

DETAILED DESCRIPTION OF THE PREFERRED EMBODIMENTS AND BEST NODE KNOWN FOR PRACTICING THE INVENTION

This invention provides well casing sealing apparatus for maintaining a watertight seal about an end of a well casing, preventing contaminants from entering the well casing and providing means for securing an electrical conduit connected to a pump located within the well casing.

Figure 1:
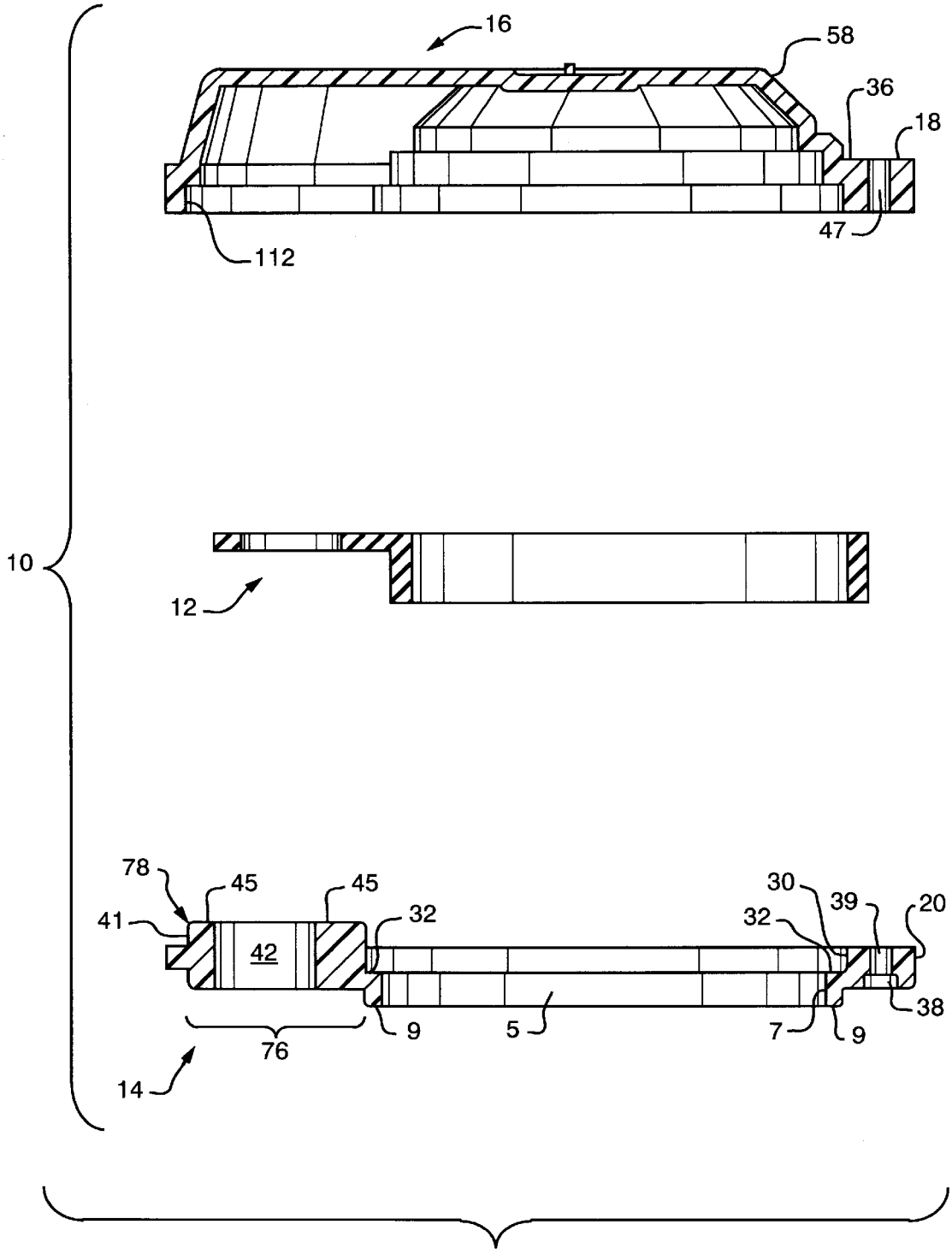
FIG. 1 is an exploded, sectional view of component parts of well casing sealing apparatus manifesting aspects of the invention.
Figure 2:
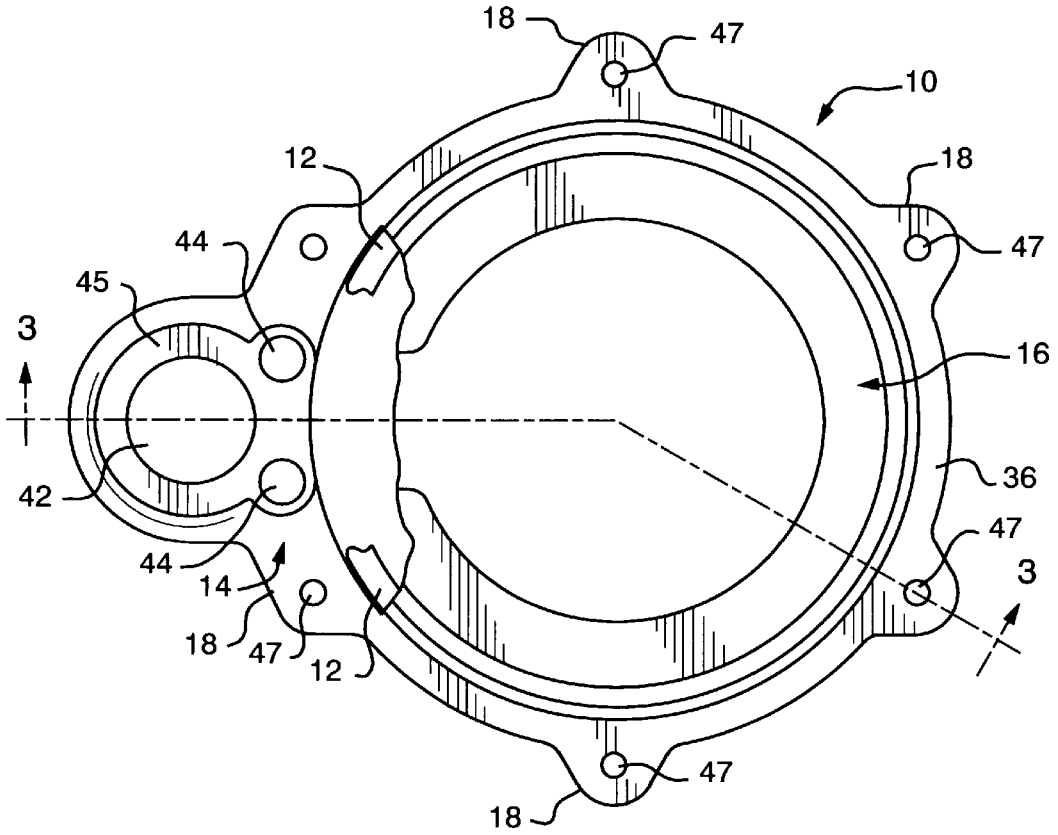
FIG. 2 is a top view of well casing sealing apparatus illustrated in FIG. 1 with the cap portion of the well casing sealing apparatus partially broken away to reveal details of the base portion of the well casing sealing apparatus.
Figure 3:
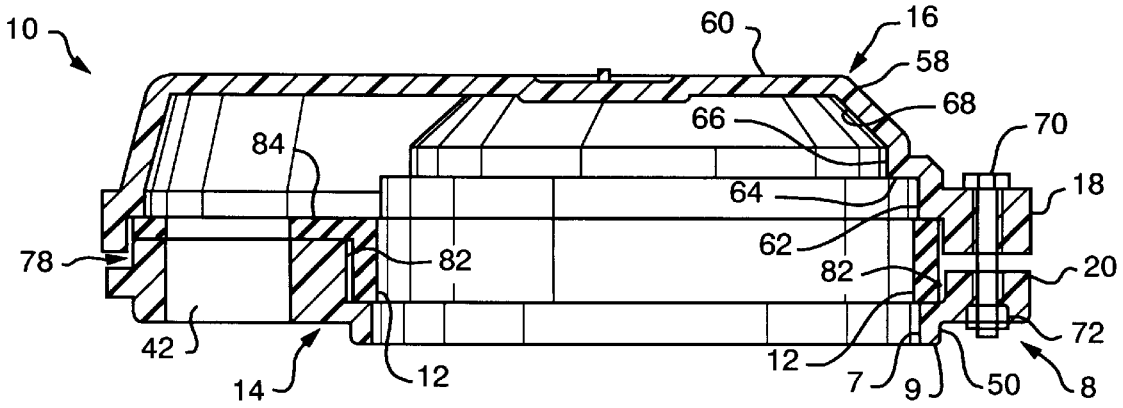
FIG. 3 is a sectional view, taken at arrows 3—3 in FIG. 2, of well casing sealing apparatus illustrated in FIGS. 1 and 2 in assembled condition.

Referring to the drawings in general and to FIGS. 1 through 3 in particular, a preferred embodiment of well casing sealing apparatus in accordance with the invention is generally designated 10 and, as illustrated in FIG. 1, includes a cap designated generally 16, a unitary elastomeric sealing gasket designated generally 12, and a base designated generally 14.

Cap 16 and base 14 are both preferably high impact ABS (acrylonitrile butadiene styrene) manufactured by injection molding and designed and fabricated in a manner that a substantially uniform wall thickness is provided throughout cap 16 and base 14 of well casing sealing apparatus 10. Both cap 16 and base 14 are preferably of integral, one piece construction, being injection molded in a single, one step operation.

Sealing gasket 12 is preferably of integral, homogeneous, uniform one piece construction and preferably manufactured of PVC (polyvinyl chloride).

Figure 11:
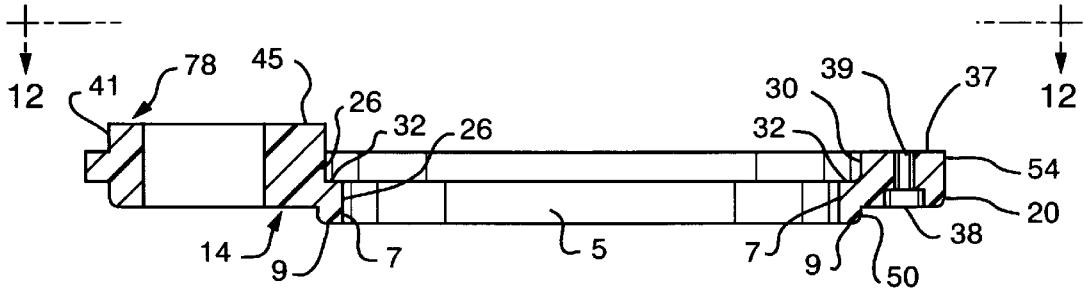
FIG. 11 is a sectional view of the base portion of the well casing sealing apparatus illustrated in FIGS. 1 through 3 taken at lines and arrows 11—11 in FIG. 12.
Figure 12:
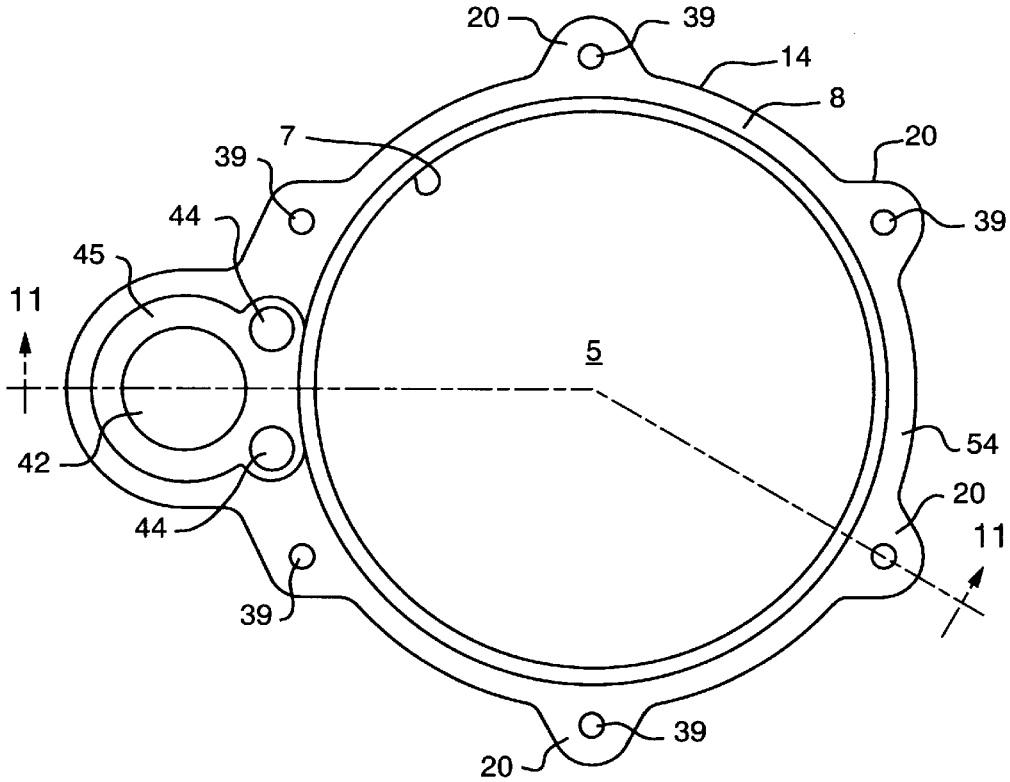
FIG. 12 is a top view of the base portion of the well casing sealing apparatus illustrated in FIGS. 1 through 3 looking downwardly as indicated by lines and arrows 12—12 in FIG. 11.

Referring to FIGS. 11 and 12, base 14 is preferably generally circular in configuration and includes an opening designated generally 5 for receiving the well casing. Base 14 further has therein a pair of generally circular vent openings 44, an internally threaded conduit opening 42, and a plurality of base lugs, which are individually designated 20, preferably disposed equiangularly about base 14. Base lugs 20 are best illustrated in FIG. 12. Lugs 20 are preferably integrally formed with base 14.

In one preferred embodiment casing opening 5 is six and three-quarters (6 and ¾) inches in diameter while threaded conduit opening 42 is one and one-half (1 and ½) inches in diameter.

Base 14 preferably slidably engages a well casing mouth section having an outside diameter preferably just slightly less than or essentially equal to diameter of casing opening 5.

Casing opening 5 in base 14 is defined by an annular inwardly facing surface 7 which preferably slidably engages the exterior of a well casing mouth.

Base 14 includes an axially downwardly facing external shoulder 9 which may contact the surrounding earth in which the well casing (which is not shown in the drawings) resides, to limit downward travel of base 14 relative to the well casing. This may occur in the event the well casing mouth section slidably passes entirely through base 14 and base 14 slides down the well casing exterior to the earth, when well casing sealing apparatus 10 and particularly base 14 is being installed about the mouth of the well casing.

Referring particularly to FIG. 3, when the ground is close to the well casing mouth, axially downwardly facing exterior shoulder 9 rests on the ground surface. The axial length of a lower outwardly facing annular wall portion 50, shown in FIGS. 3 and 11, of base 14 defines a clearance space for vent openings 44, which are not visible in FIG. 11 but are clearly shown in FIGS. 2 and 12, when casing shoulder 9 rests on a surface, generally the ground, which is horizontal with respect to the well casing mouth. Base 14 is rotatably positioned on the well casing mouth in a manner to facilitate incorporation of electrical wiring into threaded conduit opening 42 in order that electrical power may be supplied to a well pump within the casing.

Referring to FIGS. 1 through 3, 11 and 12, base 14 further includes a lip 8 projecting radially outwardly, perpendicularly to lower outwardly facing annular wall portion 50. Lip 8 includes downwardly facing hexagonal nut recesses 38, illustrated in FIG. 11, and vent openings 44 illustrated in FIGS. 2 and 12.

Vent openings 44 provide plug reception of vent caps, which are not illustrated in the drawings, for preventing contaminants from entering vent openings 44. The vent caps are preferably a corrosion resistant material preferably such as stainless steel or brass and preferably include an interwoven wire mesh for screening contaminants.

As illustrated in FIGS. 2 and 12, lip 8 of base 14 preferably includes a plurality of preferably angularly equally spaced lugs which are designated generally 20, each of which includes a downwardly facing preferably hexagonal nut recess 38 formed to the dimensions of nuts 72 and substantially corresponding thereto in pattern and depth, in order that hexagonal recesses 38 may receive nuts 72 and prevent rotation of nuts 72 on respective bolts.

Hexagonal nut recesses 38 extend upwardly and narrow to form axially extending upwardly facing circular cross-section bolt passageways 39, illustrated in FIG. 11. When base 14 and cap 16 are properly aligned, preferably hexagonal nut recesses 38 communicate via axially extending circular cross-section bolt passageways 39 with corresponding axially extending circular cross-section passageways 47 formed in cap 16. In the preferred embodiment, 3/16 (three-sixteenth) inch diameter bolts are used, threadedly engaging nuts resident in the six equiangularly spaced hexagonal nut recesses 38 formed in lip 9 of base 14.

An annular outwardly facing wall surface defines the periphery of base 14. The annularly outwardly facing wall surface defining the periphery of base 14 is axially aligned with annular first radially outwardly extending wall portion 48 of cap 16 when cap 16 and base 14 are assembled together with bolts passing through bolt passageways 39 in base 14 and bolt passageways 47 in cap 16. Extending radially inwardly, at the vertical extremity of and perpendicular to the annular outwardly flange wall surface defining the periphery of base 14, is upwardly facing annular flange surface 37. Base lugs 20 include upwardly facing bolt passageways 39 opening into flange surface 37 and formed to receive bolts 70 in a sliding fit. In the preferred embodiment three-sixteenth (3/16) inch diameter bolts are used.

As illustrated in FIG. 1, base 14 includes an ear portion 76 having a threaded conduit opening 42 formed therein. Threaded conduit opening 42 and vent apertures 44 terminate at an upper axially facing surface 45 defining a vertical extremity of ear portion 76. An outwardly facing wall portion 41 meets upper axially facing surface 45 about the periphery thereof to define an alignment shoulder 78 of ear portion 76 of base 14.

As illustrated in FIG. 11, alignment shoulder 78 extends axially respecting surface 37. This permits a tongue portion 84 of gasket 12, illustrated in FIGS. 1 and 8 through 10, to rest on surface 45 of ear portion 76, with a tongue portion 74 of cap 16 in turn resting on gasket tongue portion 84 when the well casing sealing apparatus is assembled; this facilitates alignment of respective bolt passageways in cap lugs 18 and base lugs 20.

Axially facing upper surface 45 of base 14 may optionally have formed therein a ground connection in the form of a screw received in a threaded receptacle in surface 45, providing a system fault path for electrical wiring traveling through threaded conduit opening 42.

The outwardly facing wall portion 41 of alignment shoulder 78 fits complementally with a corresponding inwardly facing wall portion 112 of the interior of tongue portion 74 of cap 16, facilitating proper positioning and alignment of cap 16, gasket 12 and base 14 when the well casing seal apparatus is assembled, as illustrated in FIG. 3.

As illustrated in FIGS. 1, 3, 11 and 12, base 14 has an annular lower radially inwardly facing surface 7 and an annular upper radially inwardly facing surface 30, with annular upper surface 30 having diameter greater than annular lower radially inwardly facing surface 7. Upper surface 30 and lower annular surface 7 are separated by an axially upwardly facing shoulder surface 32 having radial width corresponding substantially to radial thickness of unitary elastomeric sealing gasket 12. Radial width of surface 32 additionally defines the increase in diameter from lower annular surface 7 to upper annular surface 32.

Figure 10:
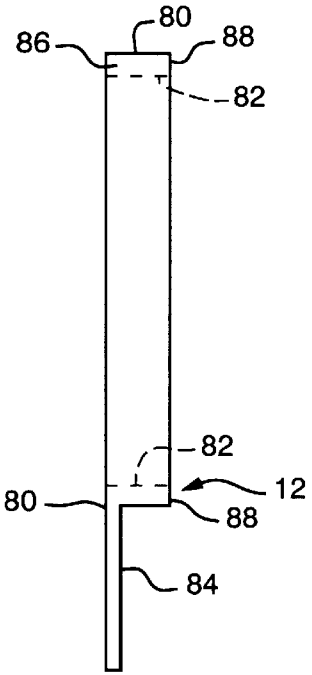
FIG. 10 is a side view of the gasket illustrated in FIG. 8.
Figure 9:
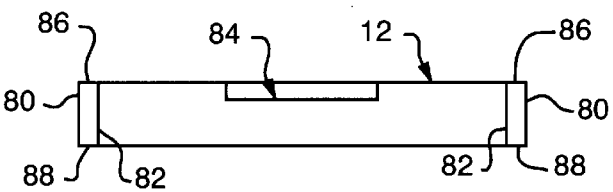
FIG. 9 is a sectional view of the gasket illustrated in FIG. 8, taken at arrows 9—9 in FIG. 8.
Figure 8:
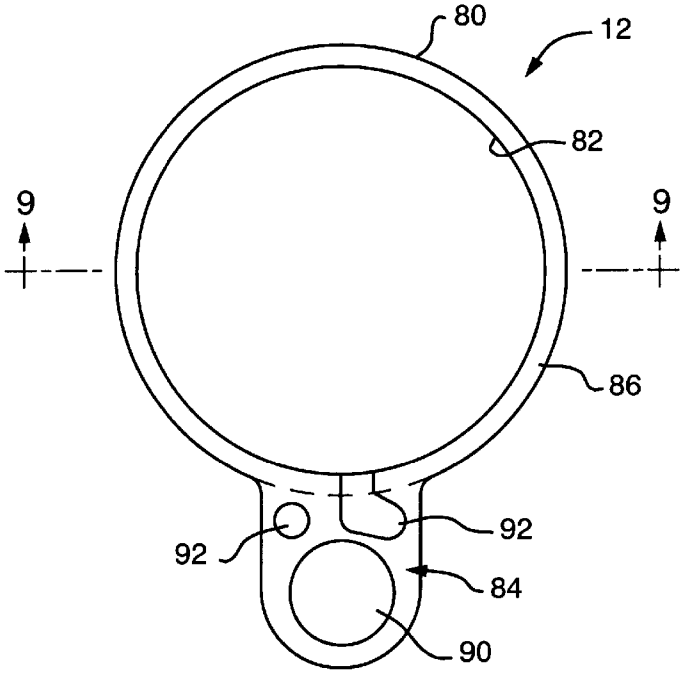
FIG. 8 is a top view of a gasket portion of the well casing sealing apparatus embodying the invention as illustrated in FIGS. 1 through 3, looking downwardly respecting FIGS. 1 through 3.

Unitary elastomeric sealing gasket 12 as illustrated in FIGS. 8, 9 and 10 has an annular outwardly facing surface 80, an annularly inwardly facing surface 82 and a gasket ear portion 84 extending away from outwardly facing surface 80. Unitary elastomeric sealing gasket 12 additionally includes an upper inwardly facing groove contacting annular surface 86 and a downwardly facing groove contacting annular surface 88. Unitary elastomeric sealing gasket 12 further includes a conduit aperture 90 and vent apertures 92, which align with conduit 42 and vent openings 44 in base 14 respectively when the well casing seal apparatus is assembled, in the manner illustrated in FIGS. 1 and 3. Apertures 90 and 92 are illustrated in FIG. 8, but are not shown in FIGS. 9 and 10 to enhance drawing clarity.

Referring to FIG. 11, axially upwardly facing shoulder surface 32, annular upper radially inwardly facing surface 30 and annular lower surface 7 together define a lower groove portion 26 of base 14. When the well casing sealing apparatus is assembled in the manner illustrated in FIGS. 1 through 3, elastomeric sealing gasket 12 is positioned in annular facing contact along annular upper inwardly facing surface 30 of base 14 and rests on axially facing shoulder surface 32.

Radial width of gasket lower groove contacting surface 88 preferably substantially corresponds to width of axially upwardly facing shoulder 32. When unitary elastomeric sealing gasket 12 is positioned within base 14, gasket inwardly facing annular surface 82 forms a single inwardly facing annular surface contiguous with annular inwardly facing surface 30 of base 14.

Gasket ear portion 84 is positioned and configured to rest on upper surface 45 of base 14. Gasket ear portion 84 conduit aperture 90 and vent apertures 92 are positioned in registry with vent openings 44 and threaded conduit opening 42 of base 14.

Cap 16, as illustrated in FIGS. 1, 2 and 3, is placed on unitary elastomeric sealing gasket 12 to effectuate sealing of the well casing mouth section.

Referring to FIGS. 4 through 7, cap 16 preferably includes a tongue portion 74 and cap lugs 18. Cap 16 further preferably includes an annular radially outwardly extending flange 36 having ear lugs 18 formed therein and which respectively correspond to lip 8 and base lugs 20 in base 14.

Cap 16 is positioned on base 14 by aligning lugs 18 and 20 and by placing tongue portion 74 of cap 16 over ear portion 76 of base 14 with gasket 12 positioned therebetween.

Figure 4:
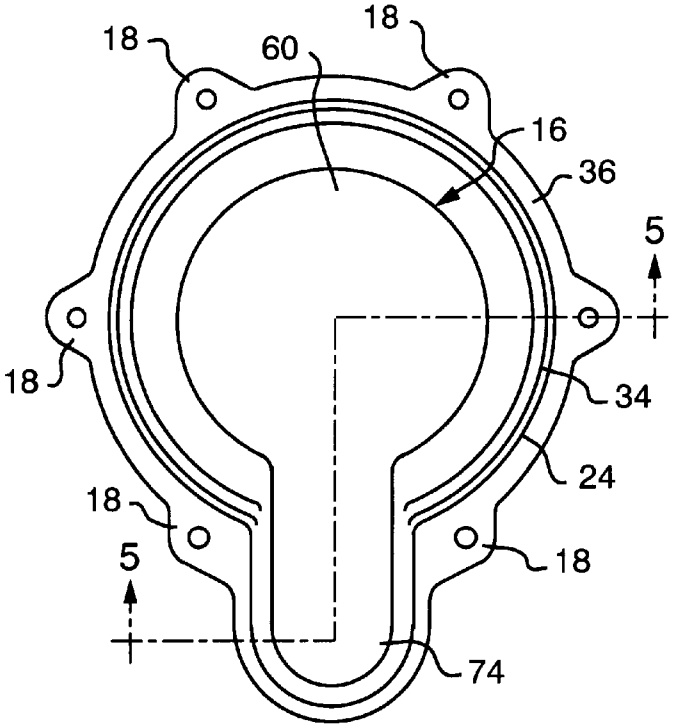
FIG. 4 is a top plan view of the exterior of a cap portion of the well casing sealing apparatus illustrated in FIGS. 1 through 3, taken looking downwardly respecting FIGS. 1 and 3.
Figure 7:
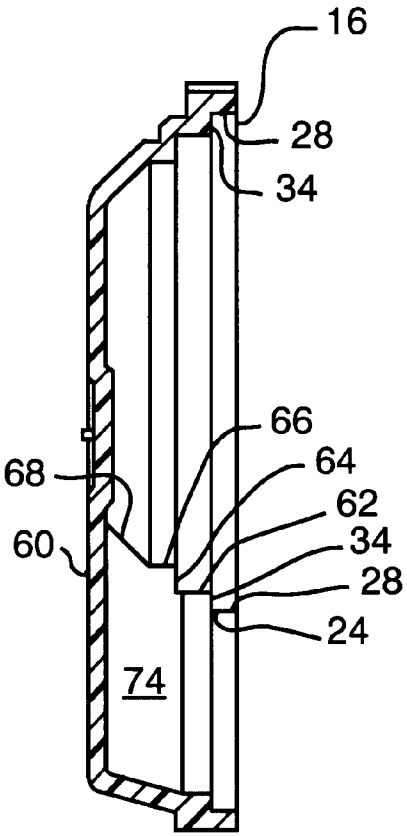
FIG. 7 is a sectional view taken at arrows 7—7 in FIG. 6.
Figure 6:
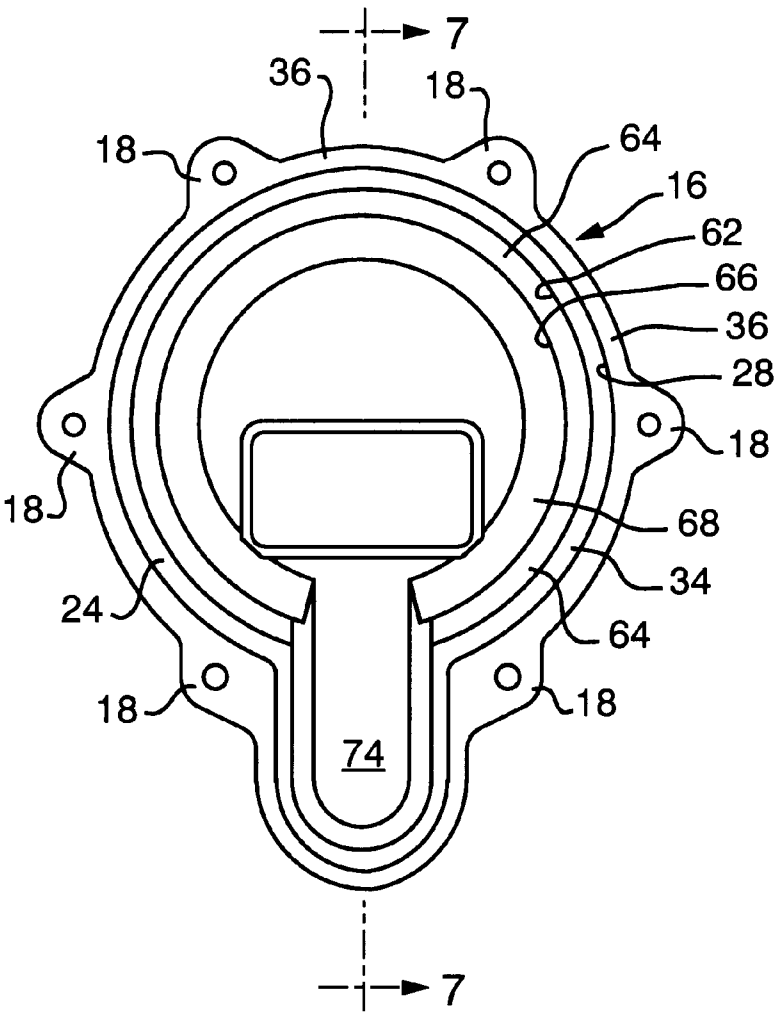
FIG. 6 is view of the interior of a cap portion of the well casing sealing apparatus embodying the invention as illustrated in FIGS. 1 through 5, taken looking upwardly respecting FIGS. 1 and 3.

As illustrated in FIGS. 4 and 6 annular radially outwardly extending flange 36 of cap 16 has protruding portions surrounding lugs 18. Lugs 18 are preferably at six (6) equidistant and equiangular positions in reference to each other, corresponding to placement of bolt passageways 20 in base 14.

Cap 16 has a first upper inwardly facing annular wall surface 28 locking inwardly with respect to base 14, which is positioned below cap 16. Annular first upper inwardly facing wall surface 28 is perpendicular to and directly below first axially downwardly facing shoulder surface 34. Together shoulder surface 34 and wall surface 28 define an upper groove portion 24 for reception of the upper groove contacting surface 86 of unitary elastomeric sealing gasket 12.

Within cap 16, a second inwardly facing annular wall surface 62 is above, with respect to base 14, first upper inwardly facing annular wall surface 28 and separated therefrom by an axially downwardly facing shoulder surface 34. Shoulder surface 34 preferably has horizontal or radial width corresponding to the thickness of upper groove surface 86 of unitary elastomeric sealing gasket 12. Axial width of shoulder surface 34 additionally defines the change in diameter between first radially inwardly facing annular surface 28 and second radially inwardly facing annular surface 34.

Referring to FIGS. 1, 2 and 3, elastomeric sealing gasket 12 is preferably positioned along first inwardly facing annular surface 28 of cap 16 and contacts axially facing shoulder 34.

Radial width of gasket upper groove contacting surface 86 preferably corresponds to radial width of axially downwardly facing shoulder 34. Unitary elastomeric sealing gasket 12 is positioned in the manner shown in FIG. 3, sandwiched between base 14 and cap 16. To effectuate good sealing about the well casing, gasket annular inwardly facing surface 82 illustrated in FIGS. 8 and 9 preferably defines an inwardly facing annular surface of smaller diameter than annular inwardly facing surface 7 of base 14 and perhaps annular second inwardly facing surface 62 of cap 16. Additionally, gasket tongue portion 84 extends to overlie tongue portion 74 of cap 16 as illustrated in FIGS. 1 and 3.

When gasket 12 is positioned between cap 16 and base 14 in the manner illustrated in the drawings and the nut and bolt combinations are tightened to draw cap 16 and base 14 together, gasket 12 is squeezed vertically. Since gasket 12 is constrained against radially outward expansion by contact with radially inwardly facing surfaces 28 and 30 of cap 16 and base 14 respectively, the vertical squeezing causes gasket 12 to expand radially inwardly effectuating a tight seal with the cylindrical well casing about which gasket 12 is positioned.

Figure 5:
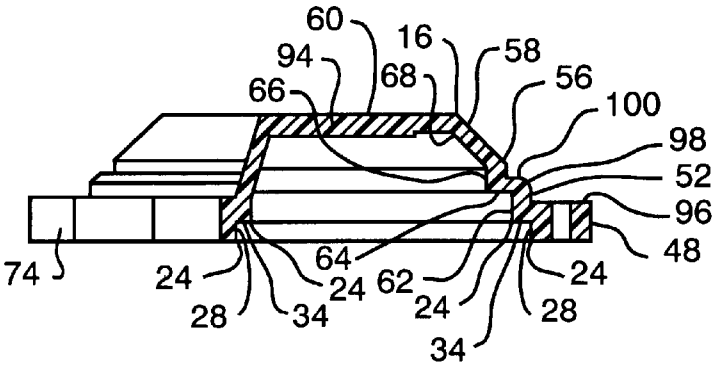
FIG. 5 is a sectional view taken at arrows 5—5 in FIG. 4.

As illustrated in FIG. 5, a second axially downwardly facing annular shoulder surface 64 is located directly above second inwardly facing annular surface 62 with respect to base 14. Axially downwardly facing shoulder surface 64 is perpendicular to second inwardly facing annular surface 62.

Still referring to FIG. 5, a third radially innermost inwardly facing annular wall surface 66 is located above axially downwardly facing shoulder surface 64 with respect to base 14. Third radially innermost inwardly facing annular wall surface 66 is separated from second inwardly facing annular surface 62 by the radial width of axially downwardly facing shoulder surface 64. Directly above third innermost inwardly facing annular wall surface 66 with respect to base 14 is angularly inwardly facing annular wall surface 68. Angularly inwardly facing annular wall surface 68 gradually projects inwardly preferably at an angle of forty-five degrees to the vertical, terminating in planar well label section 94.

Well label section 94 provides an even writing surface for the recording of water system information. Text headings "Date Inst'd", "Depth of well", "Depth of water", "Pump HP", and "Pump Setting" may be formed on the well label section 94 to promote operator record keeping, providing a convenient location for such markings.

As illustrated in FIG. 5, cap 16 has an annular first radially outwardly extending wall portion 48. The axially upwardly facing surface of wall portion 48 is defined by annular upwardly facing lip surface 96.

Located above upwardly facing lip surface 96 with respect to base 14 is an annular second outwardly facing wall portion 52 which extends upwardly into an annular angularly outwardly facing wall portion 98. Located above annular angularly outwardly facing wall portion 98 with respect to base 14 is axially upwardly facing wall portion 100. Axially upwardly facing wall portion 100 projects inwardly to join a third annular outwardly facing wall portion 56.

Third annular outwardly facing wall portion 56 is located above axially upwardly facing wall portion 100 with respect to base 14, and projects upwardly at an angle perpendicular to axially upwardly facing wall portion 100.

Transition section 58 is located above third annular outwardly facing wall portion 56 with respect to the base, sloping inwardly preferably at an angle of forty-five degrees to a central portion 60 of cap 16.

This construction results in cap 16 having substantially a constant, uniform thickness in the region overlying the well casing, as illustrated in the drawings, making cap 16 highly resistant to shock impact loading, which is most desirable.

In an alternative embodiment, central portion 60 may additionally comprise a threaded monitoring port (not shown) and plug (not shown) such that ground water sampling can be obtained without disassembly of the seal deice 10.

What is claimed is:

1. A device for closing an upper open end of a cylindrical well casing, comprising:

a. an annular elastomeric sealing gasket having an inner diameter selected for complemental fitting of said gasket around said cylindrical well casing exterior;

b. a base having an upwardly facing circumferential groove for receiving a lower portion of said gasket therein and having a circular opening slightly larger than the exterior diameter of the well casing positioned coaxially with and below said groove permitting the base to be positioned about the upper end of the well casing, further comprising:

i. a plurality of lugs positioned about the outer periphery of said base, extending radically outwardly therefrom and being integrally constructed therewith, said lugs having non-circular downwardly facing recesses formed therein and being equiangularly positioned about the periphery of said base;

ii. an annular flange projecting downwardly from the lower surface of said base, concentrically arranged with respect to said opening and having a cylindrical inwardly facing surface extending axially downwardly from said groove;

iii. said groove having an annular inwardly facing wall surface parallel with said flange inner surface and an axially upwardly facing shoulder surface perpendicular to said flange inwardly facing surface and connecting said flange inwardly facing surface with said groove annular surface; and iv. said base having an axially upwardly facing surface adjoining said groove annular surface;

v. upper surface extremities of said lugs being coplanar and axially facing, parallel with said base axially upwardly facing surface; and c. a cap having a downwardly facing circumferential groove for receiving an upper portion of said gasket therewithin, comprising;

i. a plurality of lugs positioned about the outer periphery of said cap, extending radially outwardly therefrom and being integrally constructed therewith, said lugs having non-circular upwardly facing recesses formed therein and being equiangularly positioned about the periphery of said well cap for axial alignment with lugs of said base;

ii. an inwardly facing annular surface parallel with said flange cylindrical inwardly facing surface;

iii. an axially downwardly facing shoulder surface perpendicular to said annular inwardly facing surface;

iv. said lugs of said base and said cap being adapted for axial alignment with axial apertures formed in respective ones of said lugs being axially aligned; and v. fastener means within said apertures for urging said cap and said base towards one another thereby compressing said gasket between said shoulder surfaces and causing said gasket to deform radially inwardly thereby providing a seal about said cylindrical well casing.

2. The device of claim 1 wherein said recesses are polygonal and said fastener means include polygonal portions adapted to reside non-rotatably within said recesses.

3. The device of claim 1 wherein said fasteners reside within said apertures and include first and second threadedly engaging members which converge upon relative rotation therebetween, thereby to force said base and said cap towards one another compressing said gasket and causing said gasket to deform radially inwardly.

4. The device of claim 1 wherein said cap includes an annular wall extending axially away from said shoulder surface of said groove and a second shoulder surface extending radially inwardly from said aforementioned annular surface and a third annular surface extending axially from said aforementioned second shoulder surface, a frusto-conical surface extending from said aforementioned annular surface away from said gasket and a circular top surface adjoining said frusto-conical surface.

5. The device of claim 1 wherein said cap is of uniform thickness.

6. The device of claim 1 wherein said gasket is polyvinyl chloride.

7. The device of claim 1 wherein said base and said cap are plastic.

8. Apparatus for closing an open upper end of a cylindrical well casing, comprising:

a. a cap;

b. a base;

c. said cap and base each having mutually facing annular surfaces respectively defining annular axially facing upper and lower surfaces of a circumferential internal groove, said cap and said base having parallel radially inwardly facing surfaces defining a circumferential inwardly facing wall of said groove;

d. a gasket residing in said groove and fitting circumferentially about and upper end of said well casing;

e. said cap and said base each having first annular wall portions bounding said radially inwardly facing circumferential groove surface of common axial and radial length defining common cap and base wall thickness;

f. said cap and base each having second annular wall portions bounding said mutually facing annular surfaces defining said annular axially facing surfaces in turn defining upper and lower extremities of said groove above and below said groove, having axial and radial length substantially in common with said cap and base first annular wall portion;

g. a third annular wall portion of said cap extending axially upwardly therefrom;

h. said cap having a central portion extending over said well casing open upper end;

i. said cap and said third annular wall portion having common thickness;

j. a transition section connecting said cap and said third annular wall portion, having common thickness with said cap and said third annular wall portion, said transition section being continuous and comprising a series of sections having straight and parallel inner and outer surfaces, at least some of said sections adjoining one another being perpendicular to one another;

k. wherein said cap central portion includes a laterally protruding tongue portion extending radially therefrom;

l. wherein said base includes a laterally protruding ear extending radially therefrom;

m. said tongue overlying said ear and having a top portion substantially parallel and co-planar with said central portion of said cap.

9. A device for closing an upper open end of a cylindrical well casing, comprising:

a. an elastomeric sealing gasket complementally fitting around said well casing;

b. a base having a groove for receiving said gasket therein, having an opening slightly larger than the well casing positioned below said groove permitting the base to be positioned about the upper end of the well casing;

c. a cap having a groove for receiving a second portion of said gasket therewithin;

d. means for urging said cap and said base towards one another thereby compressing said gasket between said grooves and causing said gasket to deform radially inwardly thereby providing a seal about said cylindrical well casing; and e. said cap being of unifrom thickness throughout the portion overlying said well casing open end;

wherein said cap portion overlying said well casing open end comprises a plurality of successively radially smaller annular wall segments successively disposed perpendicularly to one another; and wherein said successively radially smaller wall segments are of uniform thickness.

10. The device of claim 9 wherein a central part of said cap portion overlying said well casing is planar.

11. The device of claim 10 wherein said planar central part of said cap portion is of substantially the same thickness as said successively radially smaller wall segments.

12. The device of claim 11 wherein said central planar part of said cap portion is connected to said radially smallest wall segment by a transition portion which is substantially at a 45° angle to the axis of said cap.

13. The device of claim 12 wherein said transition portion is substantially the same thickness of said planar portion and said successively radially smaller wall segments.

* * * * *